United States Patent [19]

Maney

[11] 4,186,446

[45] Feb. 5, 1980

[54] ADJUSTABLE PAPER CAP

[76] Inventor: Thomas P. Maney, 535 Greenglade Ave., Worthington, Ohio 43085

[21] Appl. No.: 920,209

[22] Filed: Jun. 28, 1978

[51] Int. Cl.[2] ..... A42B 1/22

[52] U.S. Cl. ..... 2/197; D2/254

[58] Field of Search ..... 2/195, 197, 196, 63, 2/171.3, 175, 183; D2/254

[56] References Cited

U.S. PATENT DOCUMENTS

| | | | |
|---|---|---|---|
| 2,111,444 | 3/1938 | Bauer | 2/197 |
| 2,669,275 | 2/1954 | Haegele | 2/197 |
| 2,856,608 | 10/1958 | Wagenfeld | 2/197 |
| 2,990,552 | 7/1961 | Villers | 2/195 |
| 4,021,859 | 5/1977 | Burke | 2/197 |
| 4,055,857 | 11/1977 | Brucciani | 2/197 |

*Primary Examiner*—Werner H. Schroeder
*Assistant Examiner*—Andrew M. Falik
*Attorney, Agent, or Firm*—Robert E. Stebens

[57] ABSTRACT

An adjustable paper cap is provided as an article of protective headgear. The cap includes two elongated side panels formed with relatively narrow, single-folded, longitudinally extending, upper and lower marginal edge portions, one panel having two sections that are telescopically adjustable in a longitudinal direction for accommodating size adjustment, and a crown fabricated from a relatively thin, flexible sheet material formed with a multiplicity of pleats to permit substantial lateral expansion. The crown is attached at each longitudinal side to respective side panels through adhesive bonding of an upwardly directed, outermost panel of the pleated crown to the downwardly directed marginal edge portion of the respective side panel. The crown is only secured to the one side panel section to avoid interference in telescoping of the two side panel sections.

3 Claims, 10 Drawing Figures

ADJUSTABLE PAPER CAP

BACKGROUND OF THE INVENTION

This disposable adjustable paper cap is designed primarily as a result of the changing attitudes towards hair styles. While other adjustable paper caps have been previously devised, the mode of construction of the known caps is such that they inhibit the hair style by not being able to effectively accommodate the increased amount of hair. Until this time individuals who were employed in positions requiring the wearing of some form of a disposable cap also had to be content with either the wearing of a short hair style or else use pins or clips to effect adequate coverage of the hair by the cap and assure that the cap will be maintained in a proper position. Recent hair styles have increasingly relied on a "full-bodied" look. New styling techniques, the increased use of hair dryers by both men and women, and the emergence of hair styles that reflect one's socio-cultural heritage have all contributed to making present day hair styles occupy more volume than was previously the case. Meanwhile, paper caps previously available have remained virtually unchanged throughout the years and have a volume capability that has not increased to meet the increasing volume requirements.

Today, with the existence of full-bodied styles many individuals are unwilling to remain with the shorter hair styles. However, the wearing of the currently popular sytles entails a greater effort to compress the hair to fit under the existing caps. This manipulating of the hair may cause the integrity of the style to be lost. The only other practical alternative is to allow a substantial amount of hair to remain uncovered despite the serious health and safety implications.

Known examples of cap constructions of the type to which this invention is directed are illustrated in U.S. Pat. No. 3,027,564 issued to G. B. Wagenfeld on Apr. 3, 1962, U.S. Pat. No. 2,669,725 issued to O. P. Haegele on Feb. 23, 1954 and U.S. Pat. No. 3,390,405 issued to W. J. Gruber on July 2, 1978. These patents, while exemplary of prior cap constuction of this type, do not possess the advantages and improved functioning of the cap constuction disclosed herein.

SUMMARY OF THE INVENTION

This invention is directed to providing of a cap construction of the type having a pair of longitudinally extending side panels interconnected at their forward and rearward ends and with one of the panels being telescopically adjustable to permit selective size adjustment. These side panels are each formed with inwardly turned, longitudinal marginal edge portions at the top and bottom thereof. One side panel is formed in two sections that are adapted to telescopically interconnect through interengagement of their folded over marginal edge portions.

A crown is provided to extend across the upper portions of the two side panels and is formed from a sheet of flexible material with a plurality of pleats to accommodate expansion through relative separation of the two side panels. In accordance with this invention, the opposite sides of the crown are adhesively secured to the upper marginal edge portions of each panel, except for one section of the one side panel, in a manner to materially enhance the capability of the cap to be adjusted to the larger sizes. In its preferred embodiment, the crown, at each side thereof, has an outer marginal edge element that is secured to the respective marginal edge portion of a respective panel to project in a downward continuation of that panel edge portion to thereby enable the cap to provide a larger volume.

It is an important object of this invention to provide an adjustable paper cap capable of accommodating a large volume of hair to effectively cover the increased volume of hair found in current styles.

In addition, it is an object of this invention to effectuate coverage of the hair in an efficient manner, bringing about the accommodation of a maximum volume by means of a minimum amount of materials in a predetermined cap size.

Furthermore, it is an object of this invention that this cap should be disposable and inexpensive to purchase, yet attractive to wear with achievement of this object aided by the use of a relatively greater proportion of inexpensive materials.

Still further, it is an object that this cap should be capable of reducing the transmission of perspiration.

The above and still further features, objects and advantages of the present invention will become apparent upon consideration of the following detailed description of a specific embodiment thereof. Reference will be had to the accompanying drawings which illustrate an embodiment of the invention.

DESCRIPTION OF THE DRAWING FIGURES

DESCRIPTION OF THE ILLUSTRATIVE EMBODIMENT

Figure 1:
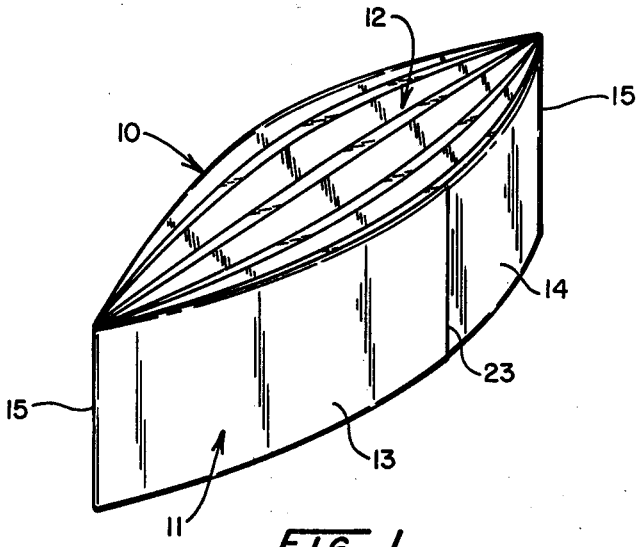
FIG. 1 is a perspective view of an adjustable paper cap construction embodying this invention.
Figure 2:
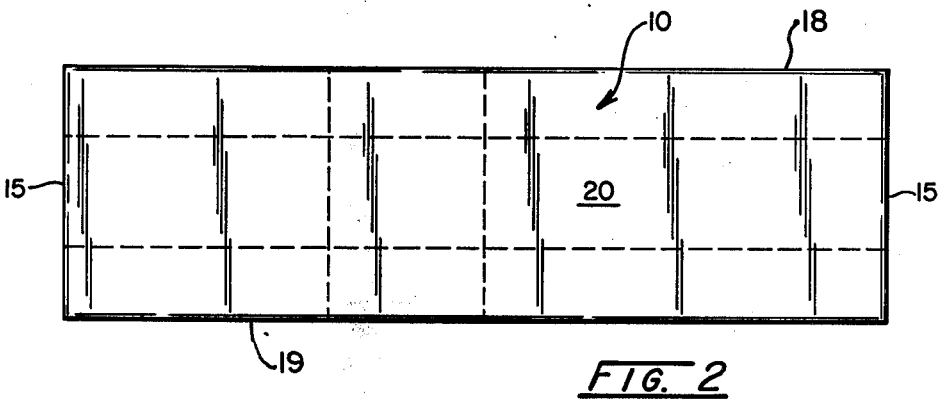
FIG. 2 is an elevational view on an enlarged scale of a first side panel as viewed from the reverse side of FIG. 1.
Figure 3:
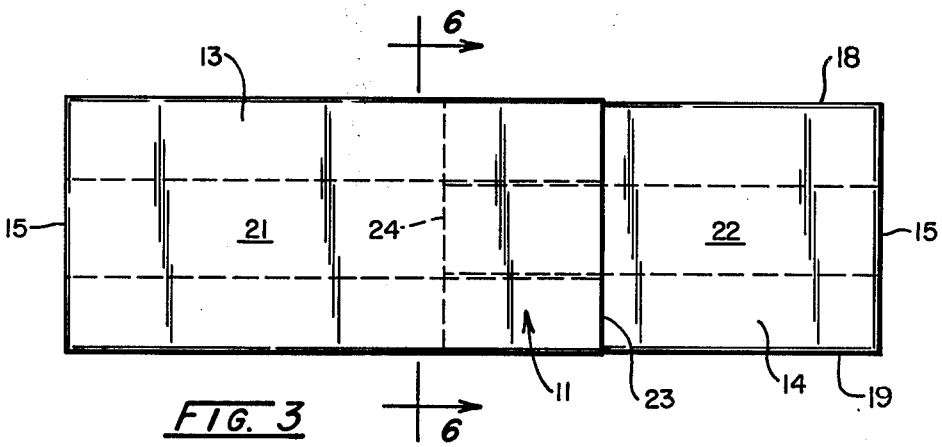
FIG. 3 is an elevational view on an enlarged scale of a second side panel of the cap as seen from the front of FIG. 1.

Having reference to the drawings, attention is directed to FIG. 1 which shows an adjustable paper cap embodying this invention. This cap incorporates the general configuration of other known caps of a similar type and includes a pair of longitudinally extending side panels 10 and 11 and a crownn 12 disposed between the side panels and extending across the space therebetween as the cap is expanded to conform to a particular person's head configuration. FIGS. 2 and 3 are side elevational view of the cap and illustrate the complete enclosure of the crown within the coextensive areas of the panels when the cap is in a flat folded configuration. Also, it will be seen in FIG. 2 that a first one of the side panels 10 is of a unitary construction while the second side panel 11 is formed in two sections that may be designated as the front and rear sections 13 and 14, as shown in FIG. 3.

Figure 4:
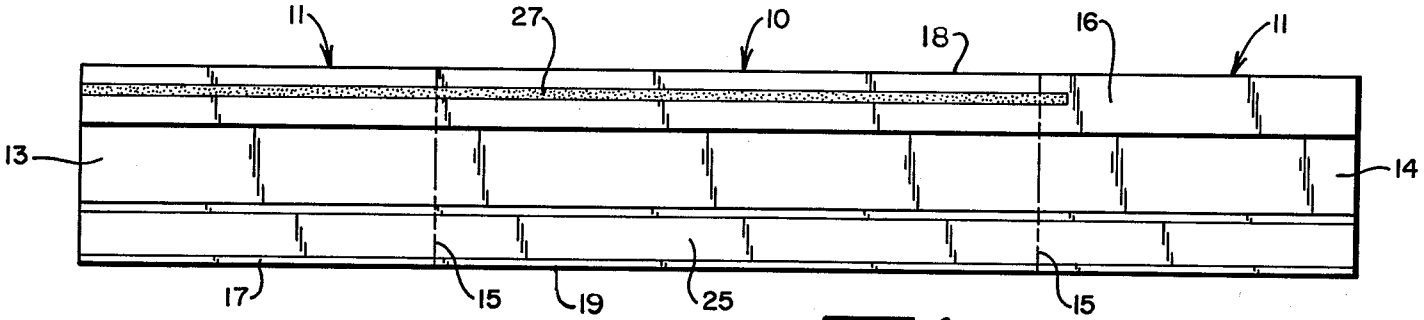
FIG. 4 is an elevational view on an enlarged scale of the interior face of the side panels when unfolded to a flat configuration showing the relation of the first side panel to the two sections of the second side panel.

General construction of the two panels will be better understood with reference to FIG. 4 which shows the two panels 10 and 11 disposed in a relatively unfolded configuration and without the crown. This is the configuration of the two panels upon their completion as a subassembly prior to folding and assembly with the crown 12. In this view, which is a view of the panel surfaces which will be inwardly facing when folded, it will be seen that the front and rear sections 13 and 14 which will ultimately be assembled to form the second panel 11, are integrally formed with the first panel 10 as extensions or continuations thereof. Each section is distinguishable from the first panel by the respective scored fold line 15 that extends transversely across the panels.

Upper and lower marginal edge protions 16 and 17 extending along the respective edges of panel 10 and panel sections 13 and 14 are folded relatively inward along upper and lower fold lines 18 and 19 to the main outer walls 20 of the first panel 10 and 21, 22 of the two second panel sections. In accordance with this invention these marginal edge portions are of a relatively narrow width, about 2.8 centimeters, compared to a total panel width of about 9 centimeters in the case of a cap with the first panel 10 having a length of about 28 centimeters. These dimensions are by way of example and it will be understood that a particular hat may be otherwise dimensioned although preferably the illustrative proportions would be retained. It will also be noted that the front and rear sections 13 and 14 have their respective free ends 23 and 24 appropriately dimensioned to permit their telescopic interfitting when assembled to form the second side panel 11 as shown in FIGS. 1 and 3. When thus assembled, the free end 24 of the rear section has the edges thereof inserted between the opposed surfaces of the outer wall 21 of the first section and associated upper and lower marginal edge portions 16 and 17.

The lower marginal edge portion 17 also functions as a sweatband. Since the panels 10 and 11 are preferably formed from a sheet-form paper material that is not necessarily impervious to moisture, the inwardly facing surface thereof is advantageously coated with a wax-like substance, or other suitable material, that is less susceptible to absorpotion of moisture to thereby inhibit transmission of moisture to the underlying paper material and to the main otuer walls 20, 21 and 22. This moisture impervious coating indicated at 25 is formed as a strip of slightly lessor width than the width of the edge portion and may be of the order of 2.5 centimeters and extends the entire length of the panels. A lessor width of such a coating may not provide the desired protection and lessor widths would tend to decrease the effectivity in situations inducing substantial perspiration and to also result in reduced cap life.

Figure 5:
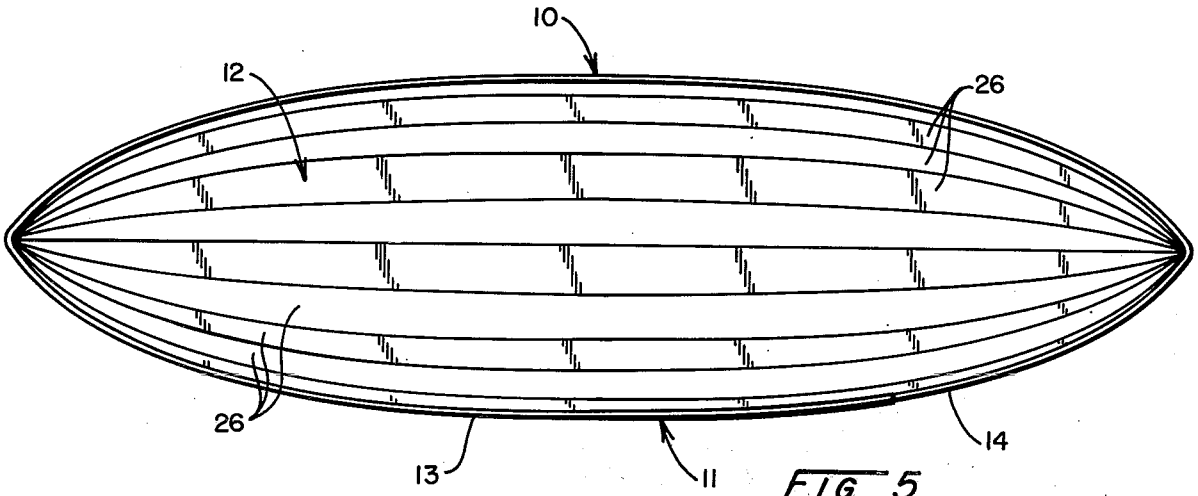
FIG. 5 is a top plan view of an opened cap disclosing the crown structure.

Secured to the upper portion of the panels 10 and 11 is the crown 12 which is formed from a sheet-form paper material that is of a relatively thinner structure than the side panels and is consequently more flexible. To enable the crown 12 to adequately expand in accommodation of the increased volume requirements, the crown is formed in a multiple pleat configuration which, in the illustrative embodiment, has eight pleat panels 26 of an approximate width of 3 centimeters. Positioning of the crown between the panels 10 and 11, which crown extends the full length of the panels 10 and 11 as can be seen in FIG. 5, is clearly illustrated in FIG. 6 where the two side panels are disposed in a separated or expanded position. It will be noted here that the number of pleat panels 26 and folding is such that the two outermost panels project in a relatively upward direction from the last fold and are disposed in coextensive relationship to the adjacent sections of the upper marginal edge portion 16 and are secured thereto by an appropriate adhesive material. Such an adhesive material may be applied as a strip-form layer 27 on the proper portions of the upper marginal edge portions when the panels are disposed in an unfolded configuration as shown in FIG. 4. This adhesive strip 27 is generally applied only to the front section of the second side panel 11 and to the first side panel 10, as shown in FIG. 4. However, the adhesive strip 27 is continued for a short distance beyond the fold line 15 associated with the rear section 14 of the second side panel for a more advantageous securing of the crown as will be further explained.

Figure 6:
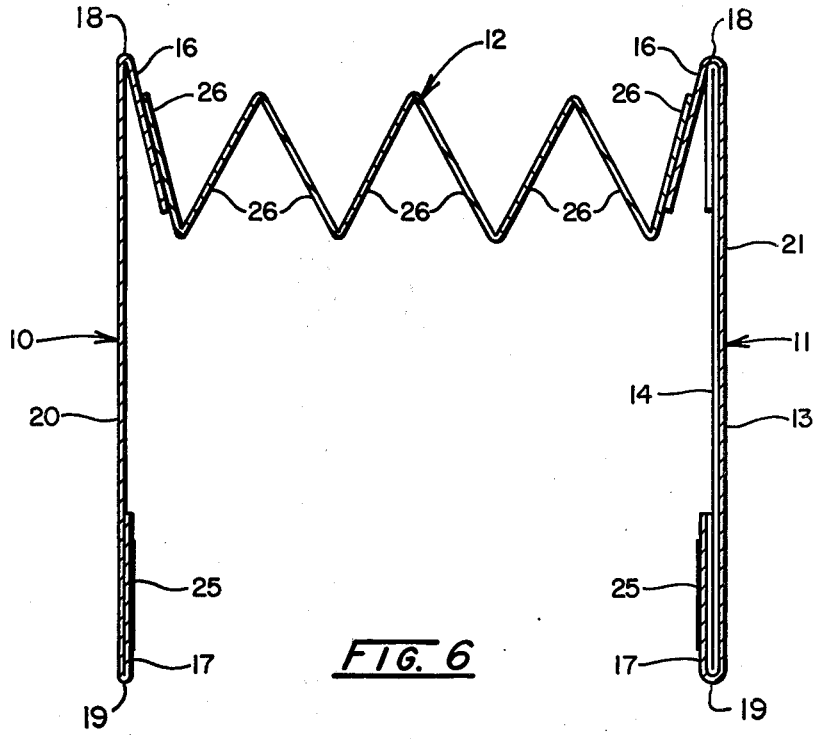
FIG. 6 is a vertical sectional view on an enlarged scale taken along line 6—6 of FIG. 3.

In this embodiment, the adhesive strip 27 is relatively narrow being of the order of 0.5 centimeter. It is preferably located at about the midpoint of the upper marginal edge portion 16 with respect to the width thereof and the edge of the outermost pleat panel 26 terminates at that position as shown in FIG. 6.

Figure 8:
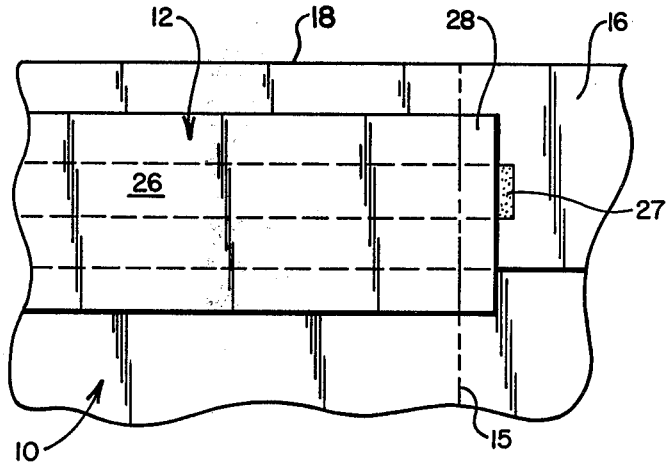
FIG. 8 is a fragmentary elevational view of a portion of the interior face of the side panels at the rear fold line juncture with the crown attached.
Figure 7:
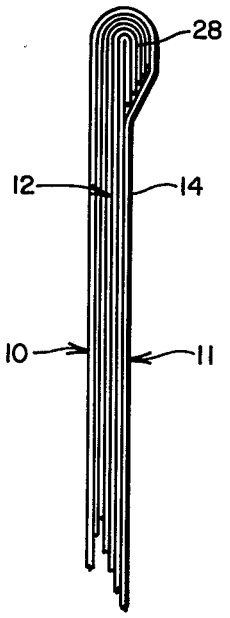
FIG. 7 is a fragmentary top plan view on a substantially enlarged scale of a rear portion of a cap in an opened or expanded configuration.
Figure 9:
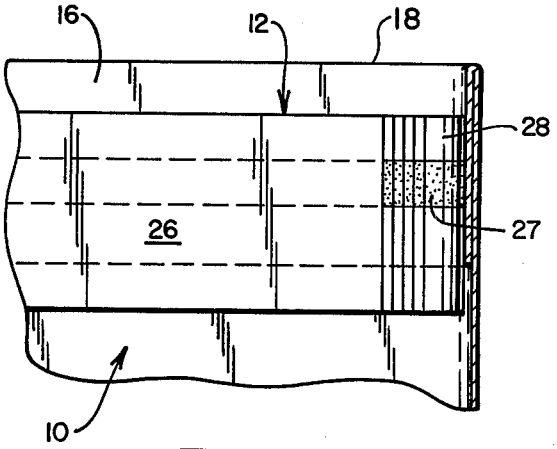
FIG. 9 is a fragmentary elevational view similar to FIG. 8 but with the terminal end edge of the crown folded over.

Also, in accordance with this invention, the crown 12 is of a slightly greater length than the first side panel 10 and can be conveniently described as having a vertical end edge portion 28. This greater length can be best seen in FIG. 7 which is a fragmentary top plan view of the cap on a substantially enlarged scale, and the enlarged scale elevational views of FIGS. 8 and 9. In assembly of the crown 12 with the side panel 10, the leading end of the crown is aligned with the fold line 15 at the juncture thereof with the second panels front section 13 thus resulting in the end edge portion 28 extending in overlying relationship to the rear section 14 of the second panel. The front section 13 is then folded over and pressed into bonding engagement with the crown. At this point in fabrication of a cap, the rear section 14 of the second side panel is folded about its fold line 15 to overlie adjacent portions of the first side panel 10 and the crown 12 which is then in a flat folded configuration. This folding operation concurrently causes the vertical end edge portion 28 of the crown to be folded over and, because of the combined thickness of the several pleat panels 26, results in a slight longitudinal separation of the panels so that the adhesive will flow onto those ends, as shown in FIG. 9, thereby causing the ends of each panel to be secured to the rear side panel section 14. This completed assembly is shown in FIG. 7.

The illustrated technique of attachment of the crown is of great importance in achieving the objectives of the adjustable paper cap of this invention. It must be emphasized that the primary object of this invention is to provide an adjustable cap capable of accommodating a large volume of hair to effectively cover the increased volume of hair found in current hair styles as well as to better accommodate the substantial differences in head sizes. Previous paper caps have employed as a place of attachment of the crown, either a point along the lower longitudinal marginal edge of their cap or at a point extending around the interior of the cap but at approximately the vertical midpoint of the headband. The unique approach of this invention in positioning the crown 12 in the extreme upper region of the panels 10 and 11 allows for the accommodation of a substantially greater volume in expansion of the panels to a particular person's head.

In addition to the location of the adhesive strip 27, the manner in which the crown 12 is attached to the upper marginal edge 16 is novel and unique. The state of the known prior cap construction is such that when the crowns have been attached to the headband, the direction of the part of the crown actually coming in contact with the adhesive strip has been in a downward direction. This invention positions the attaching pleat panel 26 in such a way that it is upwardly directed. The utility of this is fourfold. First this form of attachment allows for greater expansion of the crown 12 since the upper marginal edge portion 16 is free to swing slightly inwardly and away from the panel walls 20, 21 and 22 as shown in FIG. 6 when the crown 12 is subjected to expansion. Prior to this invention the crown often was attached to the interior wall of the headband itself or to a panel that was incapable of such inward movement. In these prior cases the crown had no other element capable of aiding in the expansion of the crown. Here, this method of construction allows for greater volume which is one of the important advantages that this cap possesses.

Secondly, this form of attachment allows for a greater amount of stress to be put on the cap without the crown 12 tearing away from the side panels or the associated marginal edge portions. When a crown is attached to the marginal edge portion 16 to have the outermost pleat panel 26 project downwardly, the tensile forces generated act to separate the crown from the edge portions since, at any given moment in time, such tensile force is acting against a single point, or narrow line, in the adhesive strip 27. However, this invention utilizes an upwardly directed attaching pleat panel 26. This results in a shearing force acting against the entire bonding area of the adhesive strip at a given moment. An adhesive bond is particularly adapted to resisting a shearing force thereby a greater degree of strength to be achieved by this method of attachment than was previously possible where tensile forces were applied to an adhesive bond.

In addition, this form of attachment allows for a more efficient covering of the hair by not subjecting the hair style to possible damage by excessive compression. By having the attaching pleat panel 26 directed downwardly, as in the previously known cap construction, any expansion of the headband necessitates the downward movement of the entire crown. This results in a force being applied by the crown against the hair. This force necessarily subjects many hair styles to possible and needless damage as a result of being compressed. This unique invention employs an upwardly directed attaching pleat panel 26 which, upon the expansion of the side panels 10 and 11, acts to elevate the crown 12 in a horizontal manner. This elevation of the crown 12 thus results in displacement in a direction away from the hair. Consequently, the crown 12 in this cap construction does not act to compress the hair and thus the integrity of the hair style is retained. This ability to accommodate a larger volume resulting from this novel form of attachment thereby allows for a more efficient covering of the hair while it minimized the potential damage to the hair.

Figure 10:
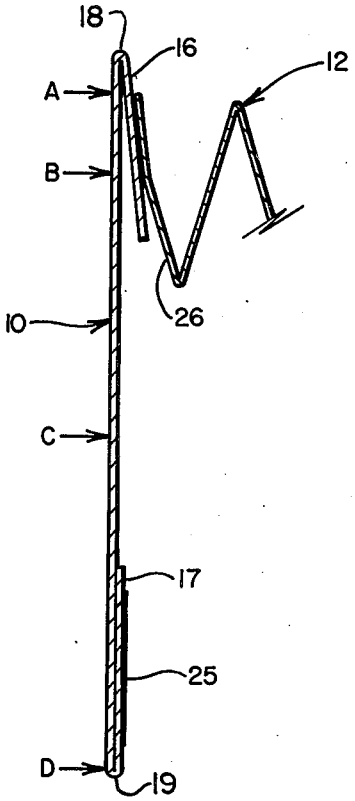
FIG. 10 is a fragmentary vertical sectional view similar to FIG. 6 illustrating functioning of the cap.

Finally, this form of attachment provides for a better fit of the cap than was previously possible. By positioning the attaching pleat panel 26 to project in an upward direction along the upper marginal edge portion 16, the greatest possible area of the panels 10 and 11 is leveraged against the hair style. Positioning the attaching pleat panel 26 as shown in FIG. 10 allows for approximately the area between points A and D on each panel to be leveraged against the hair. This provides for a better fit, yet, due to the maximum possible distance between the upper and lower marginal edge portions 16 and 17 being utilized and the unique advantages of the attaching pleat panel 26 in the illustrated manner, this fit minimizes potential damage to the hair. This fit aids in the accomplishment of the health and safety related goals of such a cap. By way of contrast, if the prior technique of downwardly directed attachment of the pleat panels were used, the area leveraged is reduced somewhat to approximately that distance between points B and D in FIG. 10, even when the point of attachment is at the upper marginal edge portion 16. This is because the advantageous feature of capability of the crown to relatively elevate is lacking thereby displacing the position of initial leverage from point A to point B. Similarly, by employing the technique of attaching the crown around the periphery of the vertical midsection of the headband or side panels the area leveraged by the crown is reduced still further to the area between points C and D. Therefore, to obtain the maximum potential are of leverage, the objective is best achieved by attaching the crown 12 to the side panels 10 and 11 by means of an upwardly directed attaching pleat panel 26 and at the maximum possible vertical elevation with respect to the lower marginal edge portion 17. Obtaining the maximum potential area of leverage is important to assure a better fitting cap.

Both longitudinal ends of the crown are attached to the respective panels 10 and 11 as shown in the several drawing figures. Attaching both ends provides for maximum hair coverage and also for better fit, since there will be a uniform displacement of the force of the hair acting against the crown. It must be realized that this is accomplished by a minimal overlap of the crown 12 at the rearward end fold line 15 as seen in FIG. 7. Some overlap is necessary to assure that the crown 12 will be securely attached as desired. However, a large overlap serves to waste material. Therefore a minimal overlap such as this invention possesses maximizes the obtaining of objectives while minimizing the use of materials and minimizes the possibility of obstructing relative telescopic movement of front and rear sections 13 and 14 of the second side panel 11. The lack of attachment of the crown to upper marginal edge portion 16 of the rear panel section 14 materially contributes to the minimal interference between crown and side panel during size adjustments while assuring that the crown will be substantially uniformly expanded throughout its entire extent thereby avoiding any gap between the crown and rear section 14 of the second side panel 11.

In addition to the fact that a minimal overlap contributes to the obtaining of objectives, both the pleated structure of the crown and the telescopic structure of the side panels 10 and 11 also serve to minimize materials. The point of attachment of the pleated crown 12 allows for a smaller vertical displacement between an initial assembled position of the crown and a position attained by the crown when the cap is worn. Previously known crown structures utilize more paper to effectuate the same degree of coverage since a larger vertical displacement of the crown is required, especially near the front and rear ends of the cap.

Also, the telescopic structure used in this invention minimizes the use of material in two ways. First, there is the use of only single folded longitudinal marginal edge portions 16 and 17. Utilizing one fold is sufficient to permit the ends to telescope effectively. The use of two or more folds as in the case of known prior cap structures serves only to waste materials and to necessitate extra steps in the production of the cap. Wider longitudinal edges are used to both assure the structural stability of the cap and, in the case of the lower marginal edge 17, to assure the incorporation of a more efficient sweatband by the application of a moisture impervious coating 25. Still, the amount of material used in these wider edges is less than that used in caps having double folded marginal edge portions. Secondly, this cap, while utilizing single folded edges does not have those edges extend the entire height of the cap. Having an edge extend the entire height of the cap is structurally unnecessary and therefore constitutes a waste factor. By constructing the cap in the manner in which this invention is constructed, the use of materials is minimized, yet the stated objectives are achieved.

Finally, the use of paper in the construction of both the crown 12 and side panels 10 and 11 permits the price of the adjustable cap to be inexpensive. Furthermore, since it is so inexpensive, it allows the cap to be disposable in order to maintain sanitary and aesthetic working conditions. Sanitary working conditions are maintained by the replacement of a soiled cap by a clean, new one. Similarly the replacement of an unattractive soiled cap by a fresh new one is aesthetically pleasing to fellow workers and the public in general.

It will be readily apparent from the foregoing, detailed description of illustrative embodiments of this invention that a particularly novel and extremely effective adjustable paper cap is provided. This cap is capable of accommodating the large volume of hair associated with current hair styles, but is equally capable of accommodating shorter hair styles due to its unique functional characteristics. Attaching the crown to the side panels at the relatively higher elevation on the upper marginal edge portion and the upwardly directed orientation of the outermost panels of the pleated crown materially enhance the ability of the cap to readily expand to a large interior space in accommodation of large volume hair styles.

Having thus described this invention, what is claimed is:

1. An adjustable cap comprising first and second elongated side panels with respective opposite ends adapted to be disposed in coexistensive relationship with each panel having opposed upper and lower longitudinally extending edges, each of said first and second panels having respective upper and lower marginal edge portions folded relatively inwardly at each respective longitudinally extending edge into superposed relationship between said two panels, said upper marginal edge portion being free to swing about its longitudinally extending edge toward the opposite side panel, said second panel being formed with a front section and a rear section extending in longitudinally aligned relationship with adjacent ends of the front and rear sections telescopically interconnected to permit relative longitudinal displacement thereof for selective size adjustment, each of said front and rear sections having their opposite ends connecting with a respective end of said first panel, and an elongated crown formed from flexible sheet material with a plurality of longitudinally extending pleated panels and having an outermost pleated panel at each side thereof secured to an inwardly facing surface of a respective upper marginal edge portion of said first and second side panels, each outermost pleated panel projecting in a direction opposite to the inwardly projecting upper marginal edge portion with at least portions of respective surfaces thereof disposed in coextensive relationship, said pleated panels disposed in coplanar relationship to said side panels when said crown is collapsed to a fully folded configuration.

2. An adjustable cap according to claim 1 wherein said crown has a rear vertical end edge portion having the pleated panels gathered into coplanar relationship and reverse folded upon itself, said vertical end edge portion being adhesively secured to the respective inwardly facing surface of the upper marginal edge portion of one of said front and rear sections of the second panel with the upper marginal edge portion of the other section of the second panel secured to the respective pleated panel of said crown.

3. An adjustable cap according to claim 2 wherein an adhesive bonding material is applied to extreme end edge portions of each pleated panel of said crown at said rear vertical end edge portion.

* * * * *